US005320360A

United States Patent [19]

St. Pierre

[11] Patent Number: 5,320,360

[45] Date of Patent: Jun. 14, 1994

[54] PORTABLE TARGET GAME APPARATUS

[76] Inventor: Aime St. Pierre, P.O. Box 682, Pine Falls, Manitoba, Canada, R0E 1M0

[21] Appl. No.: 109,261

[22] Filed: Aug. 20, 1993

[30] Foreign Application Priority Data

Sep. 24, 1992 [CA] Canada ..... 2079050

[51] Int. Cl.[5] ..... A63B 67/06

[52] U.S. Cl. ..... 273/402

[58] Field of Search ..... 273/398, 415, 400, 401, 273/402

[56] References Cited

U.S. PATENT DOCUMENTS

| | | | |
|---|---|---|---|
| 406,342 | 7/1889 | Dumont | 273/402 |
| 922,717 | 5/1909 | Parker | 273/401 |
| 1,279,654 | 9/1918 | Charlesworth | 273/401 X |
| 2,287,113 | 6/1942 | Markey | 273/401 |

*Primary Examiner*—William H. Grieb

*Attorney, Agent, or Firm*—Adrian D. Battison; Stanley G. Ade; Murray E. Thrift

[57] ABSTRACT

A target game apparatus includes an inclined main target base having a top panel and plurality of holes with a receptacle area behind the panel to receive objects when successfully falling through the holes. A vertical rear panel stands up from the rear edge of the main target base and includes one or more holes through which the objects can pass when successfully thrown. The construction can fold into a collapsed condition by pushing the receptacle base into the area behind the top panel of the main target base and by folding the rear panel rearwardly and downwardly so as to lie underneath the base panel of the receptacle. The legs fold into the area between the top panel and the sides of the receptacle.

4 Claims, 2 Drawing Sheets

PORTABLE TARGET GAME APPARATUS

BACKGROUND OF THE INVENTION

This invention relates to a portable target game apparatus of a type which when erected provides a plurality of holes through which objects can be thrown and which can be folded into a collapsed condition to allow simple storage and portability of the apparatus.

Target game apparatus are well known and one particular example includes a main target body which is inclined upwardly and rearwardly and defines a top panel having a plurality of holes through which an object such as a sandbag can be thrown. At the rear edge of the main target body is provided a vertical panel which includes a yet further target hole through which the object can be thrown. Behind the back panel and underneath the top panel are provided receptacle arrangements for collecting the sandbags as they fall through the holes so that when a player has completed a number of throws the objects or sandbags can be recovered from the relevant holes and a score tallied.

Game structures of this type are widely used and can be very beneficial particularly for older persons to maintain a level of activity and exercise. One problem with apparatus of this type is generally that it is fixed and cannot be folded so that it is relatively heavy and it takes up a significant amount of space, even when not in use. This limits the market therefore for devices of this type since they can now be installed in areas where there is sufficient space for regular use.

It is one object of the present invention, therefore, to provide an improved device of this general type which is collapsible to allow portability.

According to the invention, therefore, there is provided a portable target apparatus comprising a main target body having a top panel with a plurality of target holes in the top panel through which objects can pass when thrown at the target body, a receptacle for receiving and capturing the objects which pass through the target holes including a bottom panel mounted behind the top panel, the bottom panel being moveable from a collapsed condition adjacent the top panel to a deployed position spaced rearwardly from the top panel to define said receptacle there between, leg means supporting the target body with a rear edge thereof raised relative to the front edge thereof so that the top panel is inclined upwardly and rearwardly, and a back target panel having a target hole therein and mounted on the main target body at the rear edge thereof for pivotal movement from a raised vertical target position to a folded position lying rearwardly of said bottom panel, said leg means being collapsable to allow said main target body, back target panel and legs to be moved into a collapsed transportable position.

One embodiment of the invention will now be described in conjunction with the accompanying drawings in which:

DESCRIPTION OF THE DRAWINGS

In the drawings like characters of reference indicate corresponding parts in the different figures.

DETAILED DESCRIPTION

Figure 1:
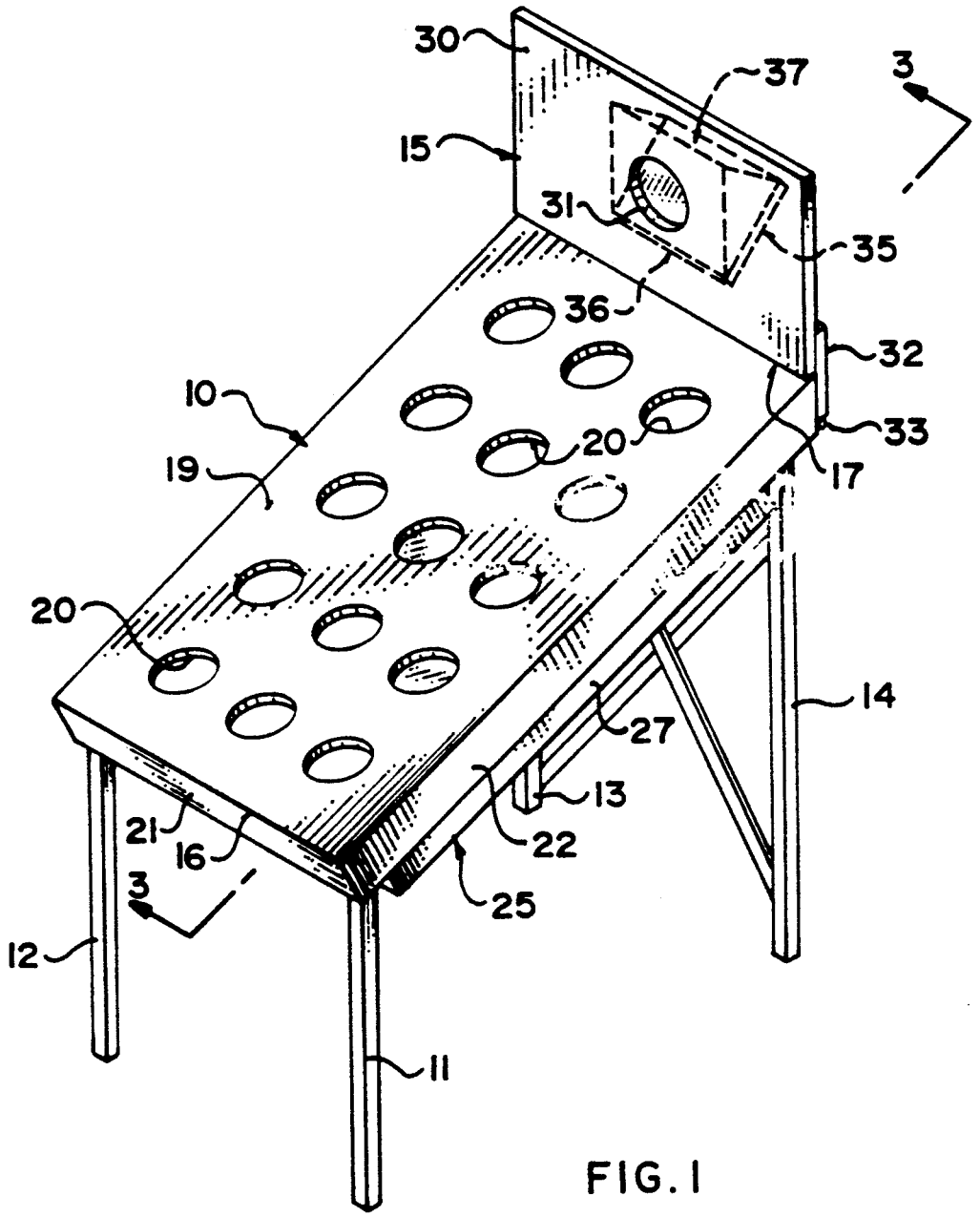
FIG. 1 is an isometric view showing the target game apparatus in erected condition.

The target apparatus comprises a main target base 10 standing on front legs 11 and 12 and on rear legs 13 and 14. In addition, the apparatus further includes a rear target panel 15 mounted at a rear edge of the main target base and upstanding from a rear edge thereof in a vertical plane. The front legs 11 and 12 are of reduced height relative to the rear legs 13 and 14 so that the main target base is inclined rearwardly and upwardly from a lowermost front edge 16 to a raised rear edge 17. The main target base includes a top panel 19 in which is provided an array of holes 20. Around the edges of the rectangular top panel 19 are provided a plurality of depending walls including a front wall 21, side walls 22 and a rear wall 23. The walls 21 and 22 extend at right angles to the panel whereas the wall 23 is inclined at a slight angle so that it is vertical in the erected condition shown particularly in FIG. 2.

Figures 2, 3:
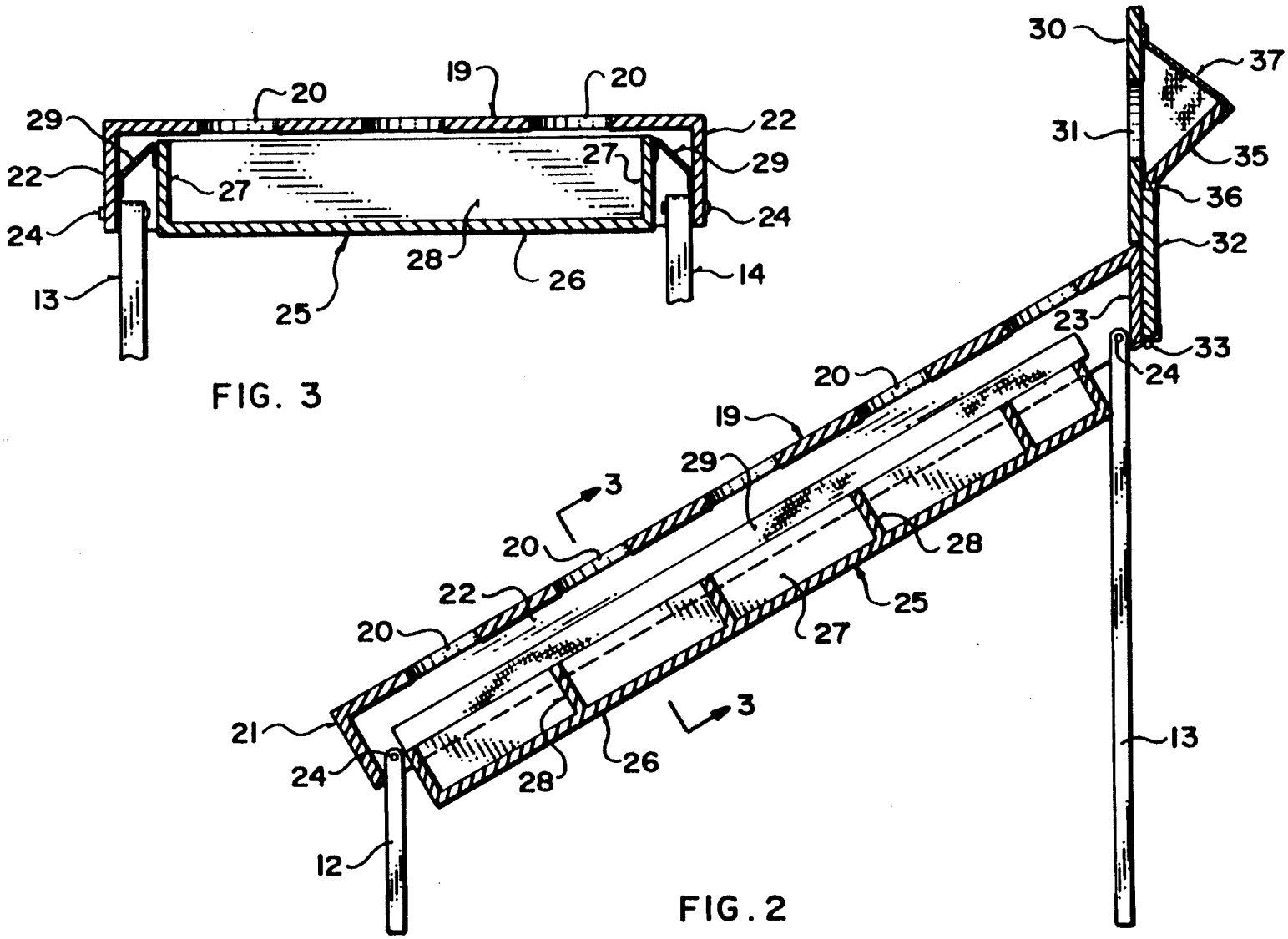
FIG. 2 is a cross-sectional view along the lines 22 of FIG. 1.
FIG. 3 is a cross-sectional view along the lines 33 of FIG. 2 with the main target base in a partially folded condition.

The legs are mounted on the inside surface of the side walls 22 as best shown in FIG. 2 with each leg being mounted on a pivot pin 24 allowing it to pivot about an axis at right angles to the leg from the erected position shown in FIGS. 1 and 2 to a collapsed condition in which the legs lie along the inside surface of the side walls 22.

The main target base 10 further includes a receptacle member 25 for receiving and holding the objects which fall successfully through the openings 20. The receptacle 25 includes a base plate 26 with upstanding side walls 27 lying parallel to and inside the side wall 22 of the top panel. The receptacle 25 further includes a plurality of divider walls 28 which act to separate the receptacle into a plurality of compartments, each for receiving the object from respective one of the holes 20 to enable to objects to be held at the opening or hole through which it passed for confirmation of a score when the objects are removed from the receptacle.

The side walls 27 are attached to the side walls 22 by a fabric strip 29 which can flex to allow the receptacle to move from an assembled position as shown in FIG. 2 in which it hangs downwardly underneath the top panel 20 to a stored or retracted position in which the side walls 27 of the receptacle are received substantially whole within the area bounded by the side walls 22 of the top panel.

The rear target panel 15 includes a rectangular rear panel 30 with a single target hole 31 through the panel for successfully receiving an object passing through the hole 31. The panel 30 is mounted on a support panel 32 which lies alongside the rear wall 23 of the top panel 19. The support panel 32 is hinged at a hinge line 33 to the bottom of the rear wall 23 so that it can be folded from the vertical erected condition shown in FIG. 2 to a folded condition (not shown) in which the panels 30 and 32 are folded underneath and alongside the base panel 26. A receptacle for the objects thrown through the hole 31 includes a pivotal panel 35 which extends across only a part of the width of the rear panel 30 and is pivoted relative thereto by the hinge line 36 at the top of the support panel 32. The pivot panel 35 is connected to the rear surface of the rear panel 30 by a fabric hood 37 which can collapse as the pivot panel is moved to the folded condition alongside the rear of the rear panel 30.

In the folding action from the erected position shown in FIG. 2, therefore, the main target base is lifted and turned onto one side so that it rests upon one side wall. The receptacle 25 can then be pushed into the area underneath the top panel by the flexing of the fabric 29. The legs can then be folded inwardly so that they lie in the area between the respective side walls 22 and 27. The rear target panel 15 is then folded around the rear wall 23 so as to lie along the underside of the bottom panel 26 with the pivot panel 35 folded flat against the rear panel 30. Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A portable target apparatus comprising a main target body having a top panel with a plurality of target holes in the top panel through which objects can pass when thrown at the target body, a receptacle for receiving and capturing the objects which pass through the target holes including a bottom panel mounted behind the top panel, the bottom panel being moveable from a collapsed condition adjacent the top panel to a deployed position spaced rearwardly from the top panel to define said receptacle there between, leg means supporting the target body with a rear edge thereof raised relative to the front edge thereof so that the top panel is inclined upwardly and rearwardly, and a back target panel having a target hole therein and mounted on the main target body at the rear edge thereof for pivotal movement from a raised vertical target position to a folded position lying rearwardly of said bottom panel, said leg means being collapsable to allow said main target body, back target panel and legs to be moved into a collapsed transportable position.

2. The apparatus according to claim 1 wherein the main target body includes side walls attached to and depending from the top panel, the legs being received inside said side walls.

3. The apparatus according to claim 1 wherein the top panel includes side walls depending from side edges thereof and wherein the bottom panel includes side walls extending upwardly from side edges thereof, the side walls of the top panel being connected to the side walls of the bottom panel by a fabric connecting member which can flex to allow the bottom panels and the side walls thereof to be pushed inside the top panel and the depending side walls of the top panel.

4. The apparatus according to claim 1 including a receptacle panel mounted rearwardly of said back target panel and pivotal relative thereto about a horizontal hinge line and including fabric connecting portions extending between sides of the receptacle panel and a rear surface of the back target panel to allow the receptacle panel to pivot from a collapsed condition lying along a rear surface of the back target panel to a receptacle position extending rearwardly from the back target panel.

* * * * *